US009158319B2

(12) United States Patent
Gowda et al.

(10) Patent No.: US 9,158,319 B2
(45) Date of Patent: Oct. 13, 2015

(54) CLOSED-LOOP ADAPTIVE VOLTAGE SCALING FOR INTEGRATED CIRCUITS

(71) Applicant: LSI Corporation, San Jose, CA (US)

(72) Inventors: Manjunatha Gowda, San Jose, CA (US); Ramnath Venkatraman, San Jose, CA (US); Thai M. Nguyen, San Jose, CA (US); Hai H. Tan, Fremont, CA (US); Prasad Subbarao, San Jose, CA (US)

(73) Assignee: AVAGO TECHNOLOGIES GENERAL IP (SINGAPORE) PTE. LTD., Singapore (SG)

( * ) Notice: Subject to any disclaimer, the term of this patent is extended or adjusted under 35 U.S.C. 154(b) by 137 days.

(21) Appl. No.: 14/089,212

(22) Filed: Nov. 25, 2013

(65) Prior Publication Data

US 2015/0109052 A1 Apr. 23, 2015

Related U.S. Application Data

(60) Provisional application No. 61/894,664, filed on Oct. 23, 2013.

(51) Int. Cl.
*G05F 1/46* (2006.01)

(52) U.S. Cl.
CPC ..... *G05F 1/465* (2013.01)

(58) Field of Classification Search
USPC ..... 327/99, 530, 538, 544–545
See application file for complete search history.

(56) References Cited

U.S. PATENT DOCUMENTS

| | | | | |
|---|---|---|---|---|
| 7,417,482 | B2 | 8/2008 | Elgebaly et al. | |
| 8,405,413 | B2 | 3/2013 | Carpenter et al. | |
| 8,412,993 | B2 | 4/2013 | Song et al. | |
| 8,975,954 | B2 * | 3/2015 | Krishnappa et al. | 327/538 |

OTHER PUBLICATIONS

"Active Management of Timing Guardband to Save Energy in POWER7," www.researcher.watson.ibm.com, 2011 [retrieved on Aug. 22, 2013]. Retrieved from the Internet: <URL: http://researcher.watson.ibm.com/researcher/files/us-lefurgy/micro44_Charles_Lefurgy_slides.pdf> (16 pages).

* cited by examiner

*Primary Examiner* — An Luu
(74) *Attorney, Agent, or Firm* — Sheridan Ross P.C.

(57) ABSTRACT

In one embodiment, an integrated circuit (IC) device includes a first logic block having performance characteristics, a first critical path monitor (CPM) configured to monitor the performance characteristics of the first logic block, and a first CPM envelope circuit enveloping the first CPM. The first logic block is configured to operate in at least one of a first functional mode and a first scan mode. The first CPM is adapted to operate in at least one of a second functional mode and a second scan mode. The first and second functional modes use higher clock frequencies, respectively, than the first and second scan modes. The first CPM envelope circuit comprises a clock-gate circuit adapted to allow the IC device to operate in a mixed mode, wherein the first CPM operates in the second functional mode while the first logic block operates in the first scan mode.

20 Claims, 8 Drawing Sheets

100

200

300

400

500

700

800

CLOSED-LOOP ADAPTIVE VOLTAGE SCALING FOR INTEGRATED CIRCUITS

BACKGROUND

1. Field

The current disclosure relates to integrated circuits, and more specifically, but not exclusively, to closed-loop adaptive voltage scaling systems and methods for integrated circuits.

2. Description of the Related Art

Minimizing power consumption by an integrated circuit (IC) is typically one of the goals of both the IC manufacturer and user. Minimizing power consumption is particularly important in mobile devices, which typically rely on batteries for their power and are not regularly tethered to an electrical power grid. In general, for a particular IC operating at a particular frequency and temperature, the lower the input voltage level for IC components, the lower the power consumption by the IC. Lowering the voltage provided to IC components, however, reduces the performance level of the IC, and lowering the voltage too much will cause operational faults on the IC, where operational faults prevent the IC from operating at the expected performance level specified in the IC's specifications provided by the manufacturer.

SUMMARY

One embodiment of the disclosure can be an integrated circuit (IC) device comprising a first logic block having performance characteristics, a first critical path monitor (CPM) configured to monitor the performance characteristics of the first logic block, and a first CPM envelope circuit enveloping the first CPM. The first logic block is configured to selectively operate in a first functional mode and a first scan mode. The first CPM is configured to selectively operate in a second functional mode and a second scan mode. The first functional mode uses a higher clock frequency than the first scan mode. The second functional mode uses a higher clock frequency than the second scan mode. The first CPM envelope circuit comprises a clock-gate circuit configured to allow the IC device to operate in a mixed mode, wherein the first CPM operates in the second functional mode while the first logic block operates in the first scan mode.

Another embodiment of the disclosure can be a method for an integrated circuit (IC) device comprising a first logic block having performance characteristics, a first critical path monitor (CPM), and a first CPM envelope circuit enveloping the first CPM, the CPM envelope circuit comprising a clock-gate circuit. The method comprises the first CPM monitoring the performance characteristics of the first logic block, the first logic block selectively operating in any one of a first functional mode and a first scan mode, the first CPM selectively operating in any one of a second functional mode and a second scan mode, and the clock-gate circuit allowing the IC device to operate in a mixed mode. The first CPM operates in the second functional mode while the first logic block operates in the first scan mode. The first functional mode uses a higher clock frequency than the first scan mode. The second functional mode uses a higher clock frequency than the second scan mode.

Yet another embodiment of the disclosure can be a method for calibrating an integrated circuit (IC) device having critical path monitors (CPMs) and corresponding logic blocks. The method comprises performing connectivity, continuity, and leakage tests on the IC device, then performing CPM self-tests to ensure the CPMs function, then performing scan tests to detect structural defects in the IC device, then performing mixed-mode testing to generate and collect CPM data, wherein: the CPMs operate in a functional mode, the corresponding logic blocks operate in a scan mode, and the functional mode uses a higher clock frequency than the scan mode, and then saving the mixed-mode testing results, including a CPM_target value for setting a voltage level for operation of the IC device.

BRIEF DESCRIPTION OF THE DRAWINGS

Other embodiments of the invention will become apparent. In the accompanying drawings, like reference numerals identify similar or identical elements.

DETAILED DESCRIPTION

One conventional method for reducing power consumption by an IC is closed-loop Adaptive Voltage Scaling (AVS). Closed-loop adaptive voltage scaling is the dynamic adjustment (i.e., adaptive scaling) of the voltage level supplied to the IC based on feedback (hence, closed-loop) received from components of the IC. Adaptive voltage scaling involves dynamically adjusting the supply voltage to components of an IC device to achieve efficient power usage that still meet the performance specifications of the IC. In particular, if present processing use is determined to allow for reducing the supplied voltage, then the supplied voltage is reduced. If additional voltage is needed to meet the IC's performance specifications, then the supplied voltage is increased. Note that a single IC device may comprise multiple types of modules as in, for example, a system on a chip (SoC). Because of process variations in the fabrication of IC dies, nominally identical dies may have variations in component dimensions that affect performance and power consumption. The temperature at which an IC operates also affects performance and power consumption.

The voltage point selected for operation may depend on the process variation particulars of the device die and on the temperature at which the die is operating. In other words, voltage V is set such that the IC's performance remains within the manufacturer's specified limits given that the IC's process variation P—which is determined by the manufacturing process—and the operating temperature T—which depends on both the ambient temperature and the power dissipation on the chip—are also within their corresponding specified limits.

One of the factors used in adaptive voltage scaling is the amount, at any particular time, of voltage slack that is available as headroom at a given operating clock frequency. A positive slack implies that there is headroom allowing for a reduction in voltage, whereas a negative slack implies that functionality of one or more critical paths is already compromised at the operating voltage, which requires raising the voltage to re-attain the specified level of functionality.

Figure 1:
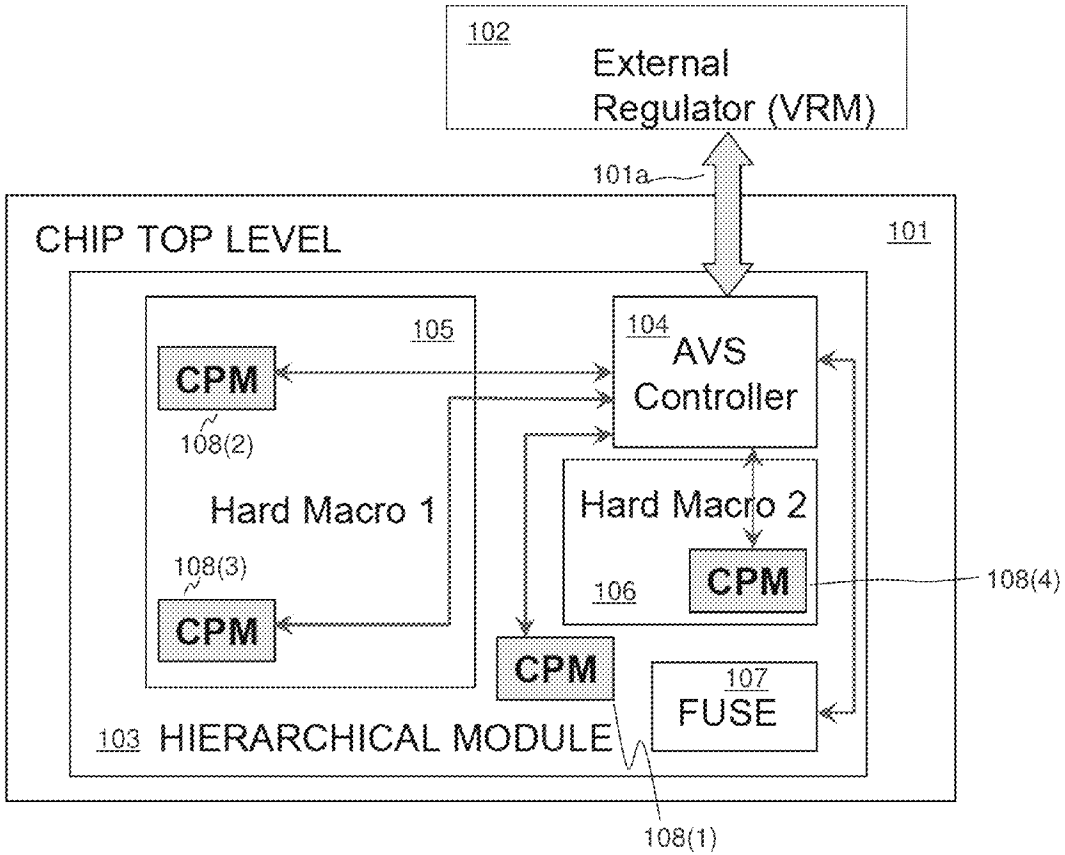
FIG. 1 shows an IC system using conventional Adaptive Voltage Scaling (AVS) control.

FIG. 1 shows IC system 100 using conventional AVS control. System 100 comprises IC device 101 and external voltage-regulator module 102. Voltage-regulator module 102 supplies a regulated voltage to IC device 101 via multi-channel path 101*a* based on the voltage level requested by IC device 101, wherein the requested voltage is provided to IC device 101 via multi-channel path 101*a*. IC device 101 requests a particular voltage by providing a corresponding voltage identification (VID) value, in the form of a binary number, to voltage-regulator module 102. voltage regulator 102 then provides a voltage level that corresponds to the received VID value.

IC device 101 comprises intellectual property (IP) block 103. IP block 103 comprises AVS controller 104, hard macro blocks 105 and 106, electrically programmable fuse (e-fuse) block 107, and critical-path monitor (CPM) 108(1). Hard macro blocks 105 and 106 comprise logic circuitry for performing given corresponding tasks. Block 105 further comprises critical-path monitors 108(2)-(3), and block 106 further comprises critical-path monitor 108(4). A critical path monitor is a circuit designed to operate as a sensor or probe to provide information about the operational performance characteristics of nearby logic circuitry since a CPM shares substantially the same process variations, voltage, and temperature as nearby logic circuitry. Critical path monitors 108 are communicatively connected to AVS controller 104. E-fuse block 107 is communicatively connected to AVS controller 104 and comprises digital fuses programmable by AVS controller 104 for the storage of certain values used by AVS controller 104.

During operation of IC device 101, AVS controller 104 receives feedback information from critical-path monitors 108, indicative of the performance characteristics of the corresponding logic circuits. Based on the received feedback information and predefined performance criteria, AVC controller 104 maintains or adjusts the voltage requested from voltage-regulator module 102.

Figure 2:
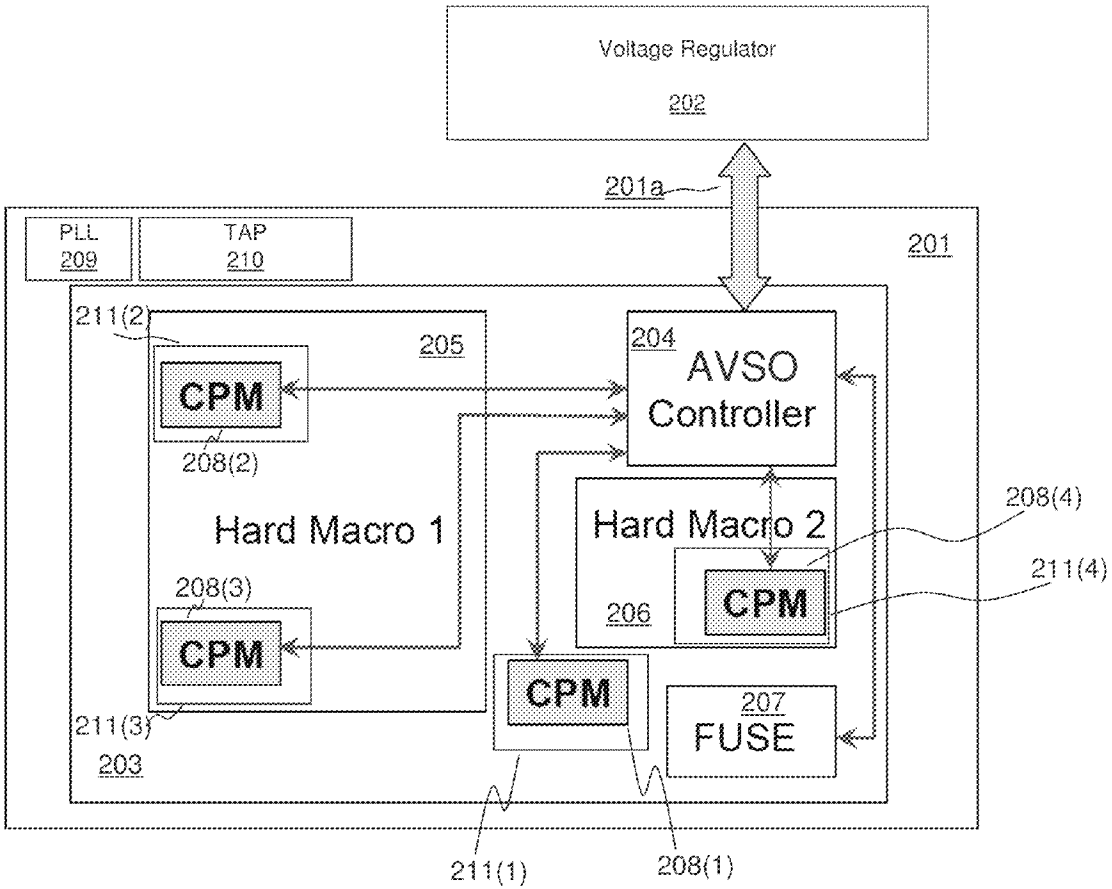
FIG. 2 shows an IC system in accordance with one embodiment of the present disclosure.

FIG. 2 shows IC system 200 in accordance with one embodiment of the present disclosure. System 200 comprises some components substantially similar to the corresponding components of system 100 of FIG. 1. Elements of system 200 are similarly labeled as corresponding elements of system 100, but with different initial characters. Unless otherwise indicated, elements of system 200 may be configured and operate substantially the same as the corresponding elements of system 100. IP block 203 of IC device 201 comprises adaptive voltage scaling and optimization (AVSO) controller 204 instead of AVS controller 104 of IP block 103. IP block 203 further comprises CPM envelope circuits 211(1)-(4) enveloping corresponding CPMs 208(1)-(4). As described below, AVSO controller 204 and envelope circuits 211 are used for improved adaptive voltage scaling.

CPMs 208 comprise circuitry designed to simulate the structure of the nearby logic circuitry. CPMs 208 are generally placed in areas of the chip which contain the more-sensitive timing paths and areas that have high switching activity. CPMs 208 of IP block 203 may be delay-path-based CPMs. In that case, CPMs 208 use the clock signal of IP block 203, and, in addition, comprise path-simulating circuitry for measuring the delay of signals through the corresponding nearby logic circuitry. Measured delay information—which may be raw, averaged, weighted, or otherwise adjusted—is then provided to AVSO controller 204. Using the information from the various CPMs 208, AVSO controller 204 then maintains or adjusts the voltage requested to be supplied by voltage regulator 202 to IC device 201. In determining whether to maintain or adjust the supplied voltage, AVSO controller 204 uses data stored in e-fuse module 207.

E-fuse module 207 may be programmed as part of the automatic testing performed on IC device 201 after fabrication. Post-fabrication testing is performed by apparatus known as automatic test equipment (ATE) as part of a process commonly called ATE testing. ATE testing typically includes scanning, which comprises testing internal components of an IC device by providing test patterns via the external pins of the IC device and deducing information about the propagation of data through the internal components by observing the data output in response to the test patterns. Scan testing includes providing test patterns at both functional clock speeds and slower—so-called scan—speeds to the IC comprising the hard macro blocks to detect whether there are manufacturing, or other, faults with the blocks.

ATE testing may include calibration to determine a CPM target value, CPM_target. The CPM target value is a target value for the CPMs' output. A CPM outputs a quantitative digital number based on the level of signal-transmission delay determined by the CPM. The CPM_target is a CPM output value that corresponds to the conditions at which there is zero timing slack in the critical path of the functional circuit. In other words, the CPM_target is the CPM output under borderline conditions when the corresponding circuit transitions from operating within the specified parameters to failing to operate at the specified parameters. As part of calibration, the supply voltage is reduced from a level at which IC device 201 operates at specified parameters to a level at which IC device 201 fails. This may be performed multiple times to get a value representative of a variety of operating conditions and IC blocks. This may also be performed on a plurality of dies in order to get data across a range of process variations. The CPM_target level may be set at the failure point or it may be offset by adding a guard band so as to reduce the likelihood of negative slack occurring. Once a CPM_target level is determined, it is stored in e-fuse block 207 and then used in operation by AVSO controller 204.

Figure 3:
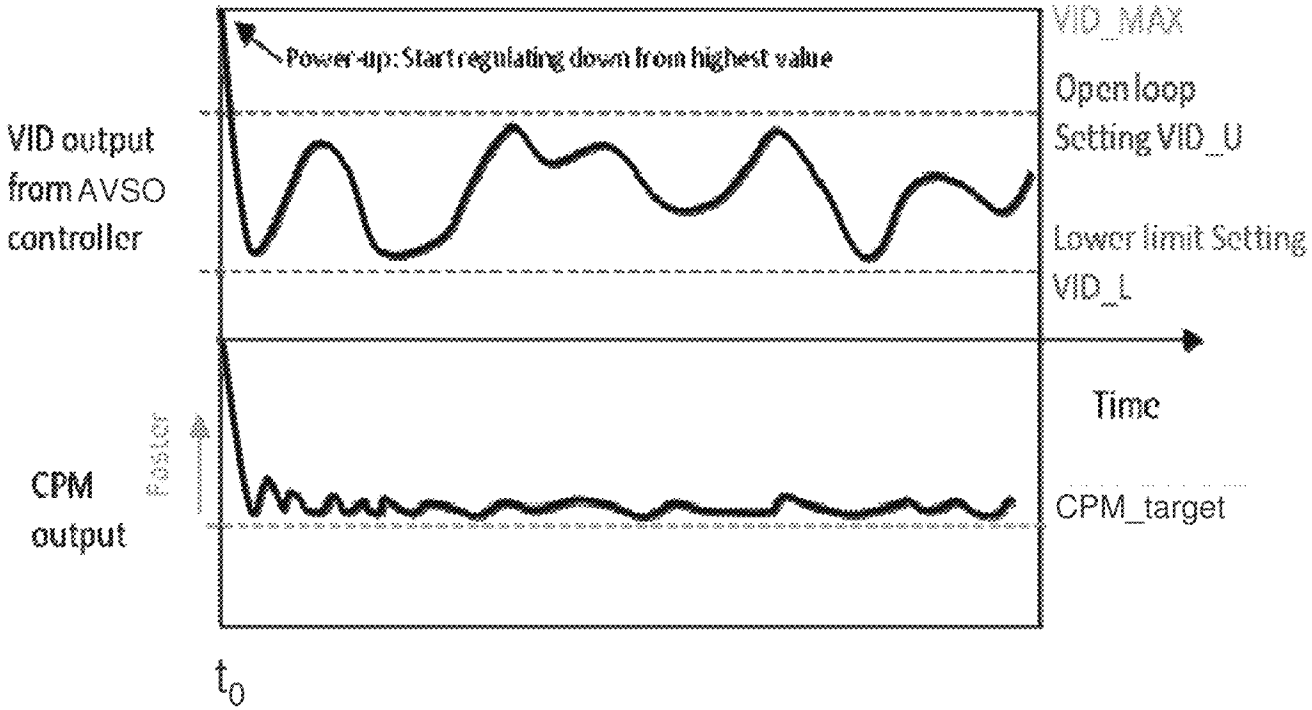
FIG. 3 shows a timing graph that shows sample Critical Path Monitor (CPM) output of a CPM and a corresponding sample Voltage ID (VID) output of an Adaptive Voltage Scaling and Optimization (AVSO) controller during startup operation of the IC device of FIG. 2.

FIG. 3 shows timing graph 300, which shows sample CPM output of CPM 208 and corresponding sample VID output of AVSO controller 204 during startup operation of IC device 201 of FIG. 2. At time $t_0$, IC device 201 powers up, and the VID output starts at the maximum VID, VID_MAX. At time $t_0$, the CPM output of CPM 208 indicates fast operation and short delay time. Following power-up at time $t_0$, AVSO controller 204 keeps the VID output between the upper operating limit VID_U—also called the open-loop setting—shown as a dashed horizontal line, and the lower operating limit VID_L, also shown as a dashed horizontal line. AVSO controller 204 dynamically adjusts the VID output so as to keep the output of CPM 208 close to, but not below, the CPM_target level, also shown as a dashed horizontal line in graph 300.

As noted above, the CPM_target level may be determined during a calibration process performed during ATE testing. ATE tests are designed to detect any of several potential problems in a fabricated IC device, such as fabrication defects and/or transition delay faults, which are failures of component output signals to stabilize within a clock cycle.

Note that CPMs typically comprise multiple paths that may be selected for use. ATE testing may include the selection of a best path through the CPM, where the best path most closely represents the actual behavior of the corresponding critical path in the nearby logic circuitry.

One ATE testing mode includes using (1) a slower scan-mode clock, or scan-clock, for controlled shifting in of data to a logic block and later shifting out of corresponding output data and (2) a faster functional-mode clock used between the data shifts for running logic-block operations, which involve transition delays within the logic block. The output data shifted out is compared with an expected output data set. If the transition delays during the functional segment are too long—in other words, if there are transition delay faults (TDFs)—then the output data shifted out will not match the expected output data set, thereby indicating the presence of one or more TDFs.

ATE testing generally includes the use of multiple test patterns for detecting TDFs, which means that there are multiple—scores, hundreds, or even thousands of—cycles of shifting data in at the slower scan speed, operating at the faster functional speed, and then shifting data out at the slower scan speed again. In conventional ATE testing, at any given time, all components on an IC device receive the same input clock signal. IC device 201 of FIG. 2, however, is capable of providing at least two separate clock signals to at least two different corresponding modules. In particular, IC device 201 is capable of providing (i) a first clock signal to the logic blocks and, simultaneously and independently, (ii) a second clock signal to CPMs 208. This allows for useful calibration techniques for a CPM_target level. Note that, at any particular time, the frequencies and/or phases of the two independent clock signals might be identical, different by a set amount, or completely unrelated.

Figure 4:
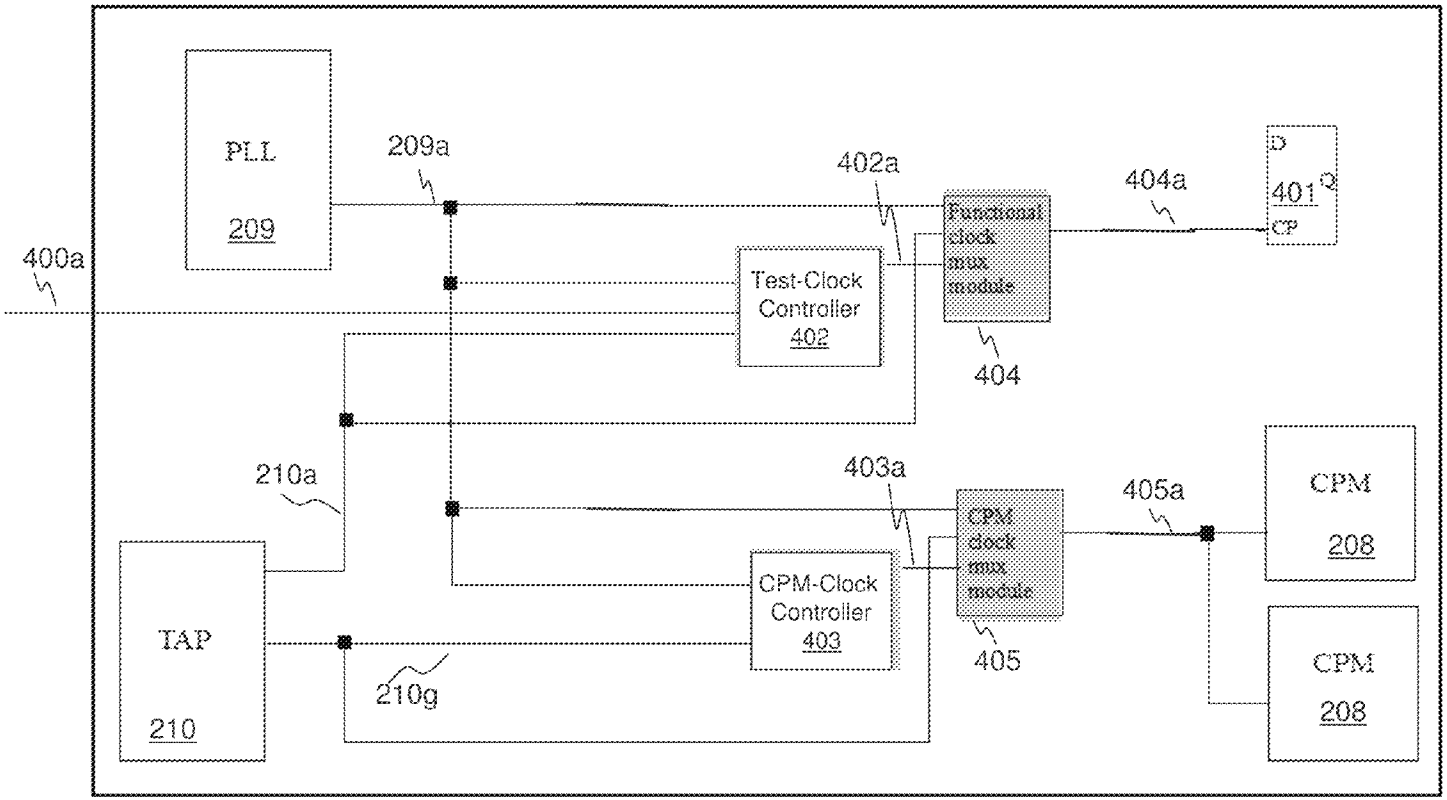
FIG. 4 shows a simplified block diagram of a segment of the IC device of FIG. 2, showing an exemplary arrangement for the provision of different clock signals to CPMs and to logic blocks.

FIG. 4 shows a simplified block diagram of a segment 400 of IC device 201 of FIG. 2, showing an exemplary arrangement for the provision of different clock signals to CPMs 208 and to corresponding logic block 401. Logic block 401 comprises one or more flip-flops, latches, and/or other registers. The provision of a separate so-called clock tree to the CPMs of IC device 201 allows for better control of the CPMs' operations and for reducing interference by other IC-device operations with CPM measurements. Segment 400 includes phase-locked loop (PLL) module 209, test access port (TAP) controller 210, test-clock controller 402, CPM-clock controller 403, functional clock mux module 404, CPM clock mux module 405, logic block 401, and CPMs 208. Note that logic block 401 represents areas of hard macros 205 and/or 206 corresponding to CPMs 208. Clock controllers 402 and 403 and mux modules 404 and 405 are located on IC device 201 and all or some may be located outside of IP block 203—like PLL module 209 and TAP controller 210.

PLL module 209 generates regular, high-frequency clock signal 209*a*. Clock signal 209*a* is provided to clock controllers 402 and 403 and to mux modules 404 and 405. TAP controller 210 provides (i) control signal 210*a* to modules 402 and 404 and (ii) control signal 210*g* to modules 403 and 405. Test-clock controller 402 also receives external slow-clock signal 400*a* from an external testing module (not shown), which is used during scan mode. An external slow-clock signal from an external testing module is used because testing is typically the only time when a slow clock is needed and using an external source eliminates the need to have on the IC a slow-clock generating module that will not be used after testing. Note that CPM-clock controller 403 may also receive external slow-clock signal 400*a* or another external slow-clock signal (not shown). However, note that controller 403 does not need to use a slow-clock signal during mixed-mode operation of this embodiment.

During normal operation of IC device 201—for example, in functional mode—TAP controller 210 controls mux modules 404 and 405 to transmit PLL clock signal 209*a* to logic block 401 and CPMs 208, respectively. During testing operations of IC device 201, clock controllers 402 and 403 provide the clock signals to be used by the mux modules. Namely, TAP controller 210 controls mux modules 404 and 405 to have them provide to logic block 401 and CPMs 208, respectively, outputs 402*a* and 403*a* from controllers 402 and 403.

During mixed-mode operation, output signal 403*a* of CPM-clock controller 403—when active—follows PLL clock signal 209*a*. Output signal 405*a* of mux module 405—when active—follows output signal 403*a* of controller 403. Output signal 402*a* of test-clock controller 402, meanwhile, follows—when active—either PLL signal 209*a* or external slow-clock signal 400*a*. Output signal 404*a* of mux module 404—when active—follows output signal 402*a* of test-clock controller 402.

Using the above-described circuitry of IC device 201, it is possible to simultaneously provide two different clock signals, a first clock signal to a logic block and a second, different, clock signal to corresponding CPMs in IC device 201. This enables logic block 401 to operate in so-called scan mode while CPMs 208 simultaneously operate in so-called functional mode. This mixed-mode operation allows CPMs 208 to more accurately measure delays along the corresponding critical paths while the critical paths are being tested. In other words, this allows CPMs 208 to operate in functional mode while corresponding logic blocks 401 are in scan mode. CPMs 208 then collect data in functional mode while the critical paths in logic blocks 401 get tested. Note that, during testing operations, logic blocks 401 operate part of the time in scan mode (slow clock) and part of the time in functional mode (fast clock), as illustrated, for example, in FIG. 6 and described below. In other words, during mixed-mode operation of device 201, the CPMs and the logic blocks may operate in different modes part of the time and in the same mode part of the time.

Figure 5:
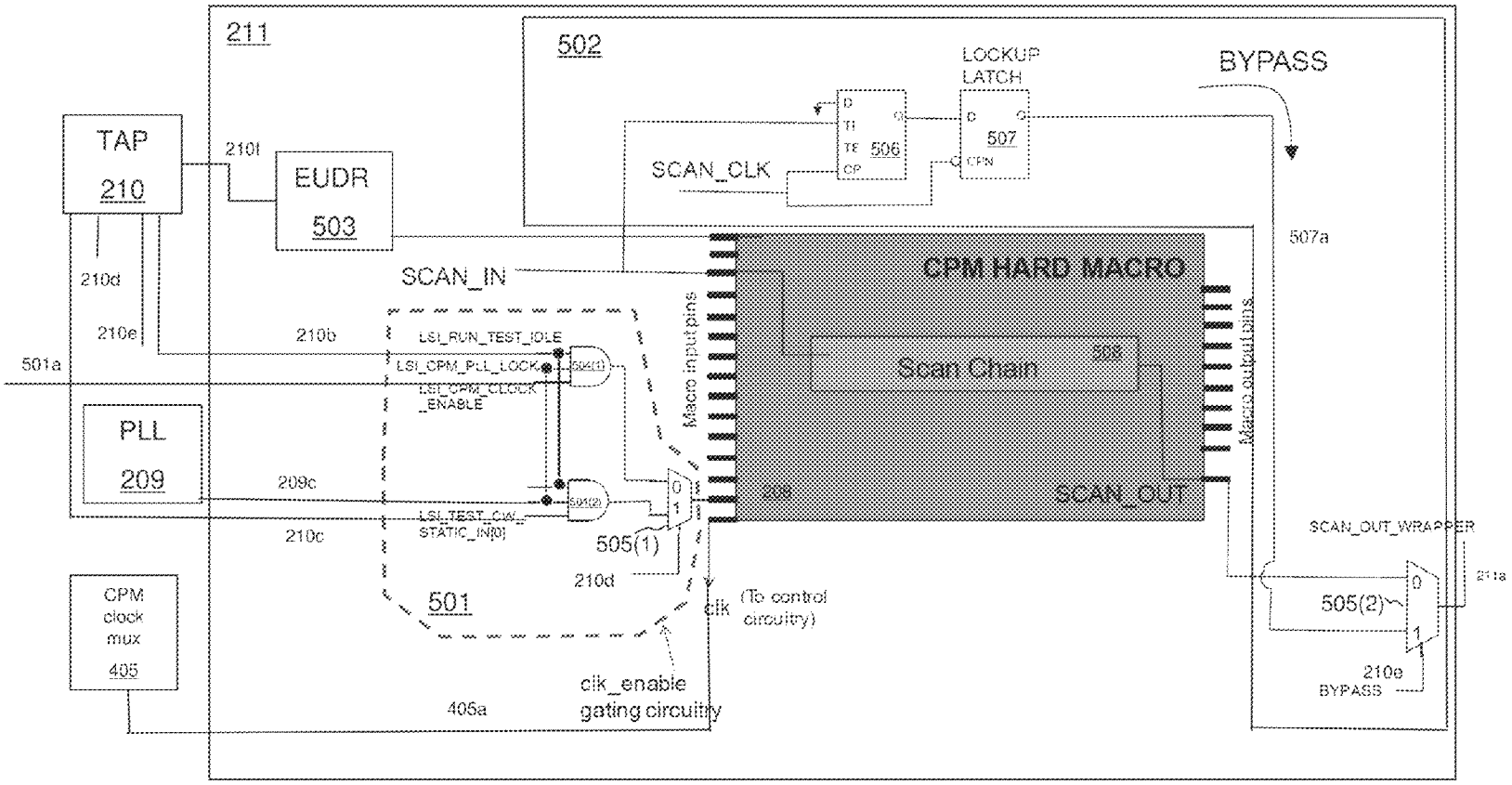
FIG. 5 shows a simplified block diagram for an exemplary circuit segment of the IC device of FIG. 2.

FIG. 5 shows a simplified block diagram for exemplary circuit segment 500 of IC device 201 of FIG. 2. Note that there is overlap between circuit segment 400 of FIG. 4 and circuit segment 500. Circuit segment 500 comprises CPM envelope circuit 211, which includes corresponding CPM 208, clock-gate circuit 501, bypass circuit 502, and external user data (EUD) register 503. Note that clock gating enables the outputs of CPM 208 to remain "frozen" when the clock-enable is turned off, thus enabling the much-slower test-clock to cleanly shift out the outputs. Note that this "freezing" feature may also be used during debugging by the testing apparatus. Also note that, as shown in FIG. 5, CPM 208 has a plurality of inputs and outputs that are used in operation and in testing, which are not described in detail herein.

Clock-gate circuit 501 comprises AND gates 504(1)-(2) and mux 505(1). Bypass circuit 502 comprises D flip-flop 506, lockup latch 507, and mux 505(2). EUD register 503 comprises a plurality of latches (not shown) and is used, for example, to provide data inputs to other components of envelope circuit 211—such as CPM 208—in a controlled manner during scan and other testing operations.

Circuit segment 500 also includes TAP controller 210, CPM clock mux module 405, and PLL module 209—described above in reference to FIG. 4,. TAP controller 210 is controlled by external testing equipment (not shown) and provides control signals to various components of circuit segment 500. Specifically, TAP controller 210 provides (a) control signal 210*f* to EUD register 503, (b) control signal 210*b* to AND gates 504(1)-(2) of clock-gate circuit 501, (c) control signal 210*c* to AND gate 504(2) of clock-gate circuit 501, (d) control signal 210*d* to mux 505(1) of clock-gate circuit 501, and (e) control signal 210*e* to mux 505(2) of bypass circuit 502. Control signal 210*f* controls the operation of EUD register 503 during, for example, scan testing of IC device 201.

TAP controller 210 also connects to conventional external test-related signal paths TDI (test data in) (not shown) and TDO (test data out) (not shown) and provides those signal paths to EUD register 503. PLL module 209 provides PLL-lock-indicating signal 209*c* to AND gates 504(1)-(2) of clock-gate circuit 501. CPM clock mux 405 provides the above-described clock signal 405*a* to CPM 208.

Clock-gate circuit 501 is used in determining when CPM 208 starts and stops receiving clock signal 405*a* during mixed-mode testing. In other words, clock-gate circuit 501 is configured to selectively activate a clock input port of CPM 208. Since clock signal 405*a* triggers components of CPM 208, clock signal 405*a* may be considered to power, or enable, CPM 208. Clock-gate circuit 501 enables CPM 208 if certain conditions are met. At other times, clock-gate circuit 501 freezes the operation and, consequently, the output of CPM 208. A first condition is that TAP controller 210 be in idle mode. Since timing of operations is important for data collection in mixed-mode testing, TAP controller 210 should be idle and available to immediately perform mixed-mode testing tasks—rather than working on another task—before data is collected by CPM 208 during mixed-mode testing. The first condition is indicated by control signal 210*b*.

A second condition is that the output of PLL 209, which is used in generating clock signal 405*a*—as explained above in reference to FIG. 4, is phase-loop locked, indicating a stable clock signal, which helps prevent skewing of the output of CPM 208. The second condition is indicated by signal 209*c* from PLL circuit 209. A third condition is that the controller of the mixed-mode testing is ready to commence mixed-mode testing and data collection. In this implementation of clock-gate circuit 501, mixed-mode testing may be controlled either by (a) TAP controller 210—which can provide simple automated operation—or (b) an external testing apparatus (not shown)—which can provide a greater level of control over testing. Signal 210*c* indicates whether TAP controller 210 is ready to commence mixed-mode testing. Signal 501*a* indicates whether the external testing apparatus is ready to commence mixed-mode testing. Signal 210*d* indicates whether it is TAP controller 210 or the external testing program that is controlling the mixed-mode testing.

The above-described logic is implemented by clock-gating circuit 501, which, as described above, comprises 3-input AND gates 504(1)-(2) and mux 505(1). As would be appreciated by a person of ordinary skill in the art, the output of an AND gate is 0 (low) unless all its inputs are 1 (high), in which case its output is 1. Both AND gates 504(1) and 504(2) receive above-described control signals 210*b* and 209*c* as inputs. AND gate 504(1) receives enable control signal 501*a* from the external testing apparatus as its third input. AND gate 504(2) receives enable control signal 210*c* from TAP controller 210 as its third input. Mux 505(1) is controlled by control signal 210*d* and provides to CPM 208 the output of (a) AND gate 504(1) if 210*d* is 0 (low) and (b) AND gate 504(2) if 210*d* is 1 (high).

During conventional chip-level scan testing, CPM 208 is tested along with rest of the scan components in the chip. Note that scan chains are linked arrangements of components in an IC device used in component testing; where those scan links are typically not used during normal, non-testing operation of the IC device. Components of CPM 208 are linked together as one or more scan chain segments, such as scan chain 508. CPM 208 also comprises a plurality of paths, each comprising a plurality of combinatorial and register components (not shown) designed to approximate a nearby critical path. During calibration it is determined which of the plurality of paths best approximates the nearby critical path. CPM 208 receives the SCAN_IN signal from a preceding component in its scan chain and provides SCAN_OUT to the next component in the scan chain.

During mixed-mode testing, when the logic block comprising CPM 208 is operating—at least part of the time—in scan mode but CPM 208 itself is operating in functional mode, CPM 208 should be bypassed during the testing without adversely impacting the testing of the logic block. This may be done by bypassing CPM 208 using bypass circuit 502. Bypass circuit 502 acts to make it appear to the testing apparatus that scan chain segment 508 of CPM 208 is not part of its corresponding scan chain so that initial values that are loaded into the scan chain are passed through CPM envelope 211 unchanged and without affecting CPM 208 or the corresponding scan chain. In mixed-mode testing, the SCAN_IN signal is received from the preceding component in the scan chain, while bypass signal 507*a* is output to the next component in the scan chain as output signal 211*a*.

During conventional operation of IC device 201, TAP control signal 210*e* is 0, and mux 505(2) outputs the SCAN_OUT signal from CPM 208 as output signal 211*a*. This allows for conventional testing of the components of CPM 208, such as, for example, scan chain 508. During mixed-mode testing, however, control signal 210*e* is 1(high), and mux 505(2) outputs bypass signal 507*a*. Bypass signal 507*a* is output by latch 507, which functions as a lockup latch for the output of flop 506. Together, flop 506 and latch 507 are connected in order to transmit the SCAN_IN signal along so that CPM 208 is bypassed during mixed-mode operation.

Flop 506 has a reference voltage (e.g., ground), SCAN_IN, a chip-level test-enable signal, and SCAN_CLK as inputs to, respectively, the data (D), test input (TI), test enable (TE), and clock pins. Note that SCAN_CLK may be signal 403*a* of FIG. 4 following external slow-clock 400*a*. During mixed-mode operation, chip-level testing is enabled. In other words, the test-enable signal to the TE pin is 1 (high). Consequently, Flop 506 outputs the input on its TI pin (rather than its data pin), as triggered by its clock input. Falling-edge-triggered latch 507 has, respectively, the output of flop 506 and the inverse of SCAN_CLK as inputs to the D and clock pins. Latch 507 outputs the input on its data pin, as triggered by its clock input. Together, flop 506 and latch 507 transmit the SCAN_IN signal in such a way as to bypass CPM 208.

Figure 6:
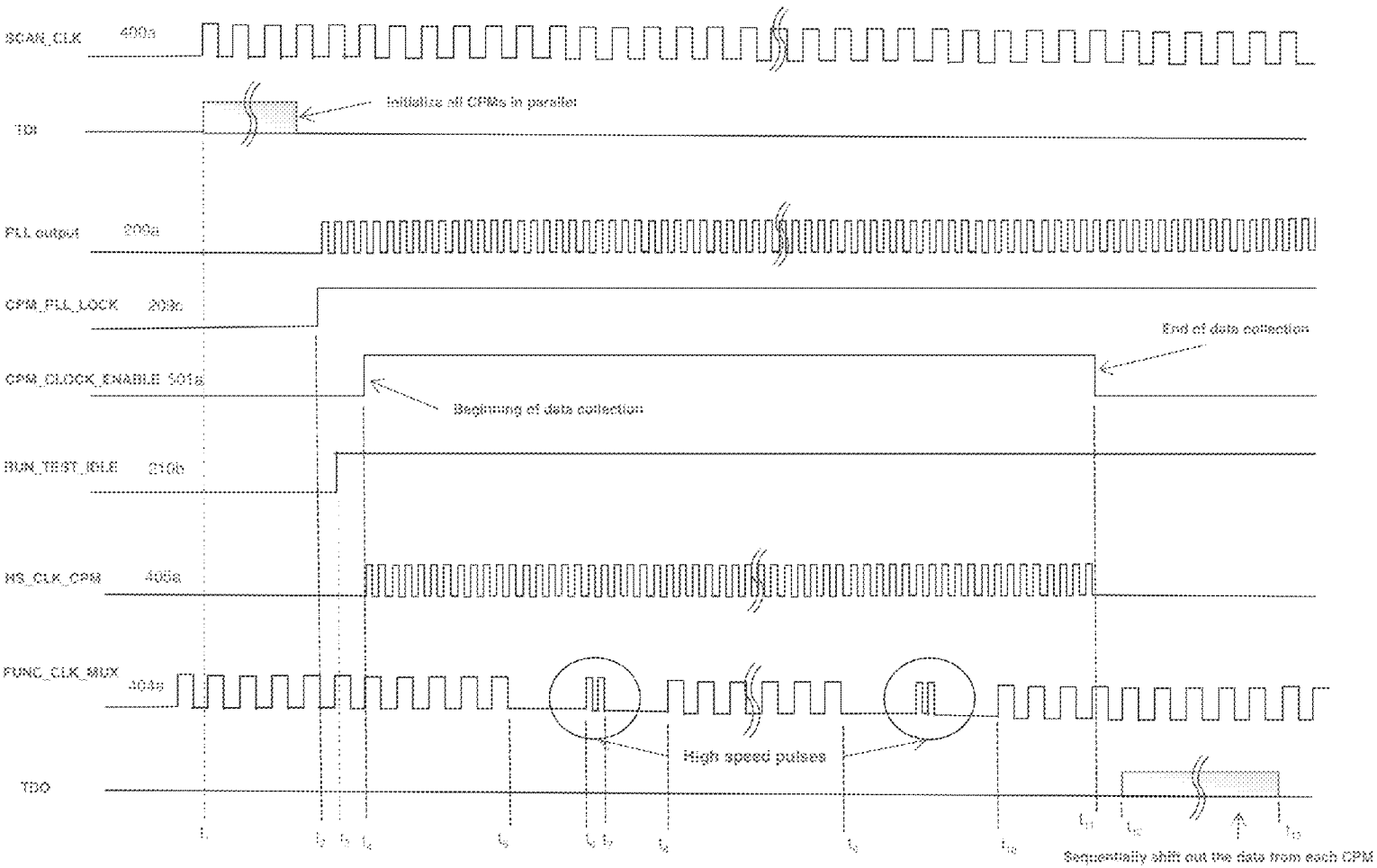
FIG. 6 shows an exemplary signal timing diagram for some of the signals of the envelope circuit of FIG. 5 in an exemplary scenario.

FIG. 6 shows exemplary signal timing diagram 600 for some of the signals of circuit segment 500 of FIG. 5 in an exemplary scenario where mixed-mode testing is controlled by external testing apparatus and, consequently, control signal 210*d* from TAP controller 210 is 0. Specifically, timing diagram 600 shows, in order from top to bottom, slow-clock signal 400*a*, TDI, PLL clock 209*a*, PLL lock signal 209*c*, control signal 501*a*, TAP-idle-indicating signal 210*b*, CPM 208 clock input 405*a*, the corresponding logic block's clock input signal 404*a*, and TDO.

From time $t_1$ to time $t_{13}$, slow-clock signal 403*a* is, as described, a relatively slow clock signal. At time $t_1$, the CPMs are initialized using data provided via the TDI signal, signal 404*a* is then following slow-clock signal 403*a*, and the other signals are low. By time $t_2$, the initialization is complete. At time $t_2$, PLL lock signal 209*c* goes high, and PLL clock 209*a* is output as a relatively fast clock signal. At time $t_3$, TAP-idle-indicating signal 210*b* goes high. At time $t_4$, control signal 501*a* goes high—initializing data collection by the CPMs—and CPM input clock signal 405*a* starts following PLL clock 209*a* and thereby powering CPM 208. At time $t_5$, a data-collection cycle starts indicated by the clock signal 404*a* going low for a few PLL clock cycles, then, starting at time $t_6$, following PLL clock 209*a* for a few clock cycles and then, at time $t_7$, going low for a few clock cycles, and then, at time $t_8$, returning to following slow-clock signal 400*a*. This data-collection cycle is repeated multiple additional times—tens, hundreds, thousands, or more—until the final data collection cycle between times $t_9$ and $t_{10}$. At time $t_{11}$, control signal 501*a* goes low, indicating the conclusion of data collection. Note that the data collection cycles are used to detect transition delay faults. Then, between times $t_{12}$ and $t_{13}$, the collected data is shifted out of the CPMs using TDO. The collected data is then used to determine a CPM_target value, as well as a preferred path through CPM 208 for representing a corresponding critical path in the corresponding logic block.

Figure 7:
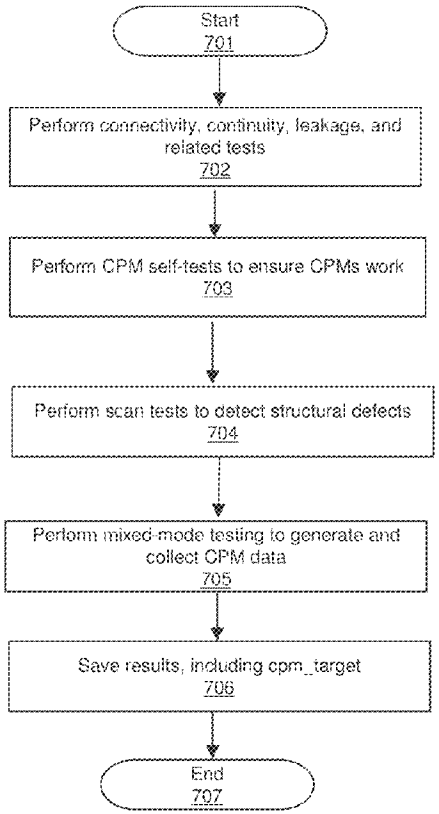
FIG. 7 shows a flow chart for a testing and calibration process by testing equipment for IC devices in accordance with one embodiment of the disclosure.

FIG. 7 shows flow chart 700 for a testing and calibration process for IC devices in accordance with one embodiment of the disclosure. Process 700 starts with step 701. The testing equipment performs connectivity, continuity, leakage, and related tests for physical manufacturing defects on the IC devices (step 702). Then the testing equipment performs CPM self-tests on the CPMs of the IC devices to verify that the CPMs function correctly (step 703). These tests involve operating the CPMs and corresponding logic blocks in functional mode to select each path within CPMs and verify CPMs are generating expected data. Next, the testing equipment performs scan tests of the IC devices to detect structural defects (step 704). Then the testing equipment performs mixed-mode testing—as, for example, described above, where CPMs are in functional mode while the corresponding logic blocks are in testing mode—to generate and collect CPM data that is used to set CPM_target (step 705). In this CPM data collection step, failure-point data is collected from multiple CPMs placed in multiple corresponding locations on each of multiple IC devices (or dies) as timing-sensitive paths in the corresponding logic blocks are exercised. Failure point data may be collected by, for example, running several selected transition delay fault tests. Multiple dies are used in order to test corresponding paths having a range of process variations. Then the results are used to determine CPM_target values, which are then saved on the IC devices by, for example, writing to non-volatile memory on the IC devices, such as e-fuse 207 of FIG. 2 (step 706). The process then terminates (step 707).

Figure 8:
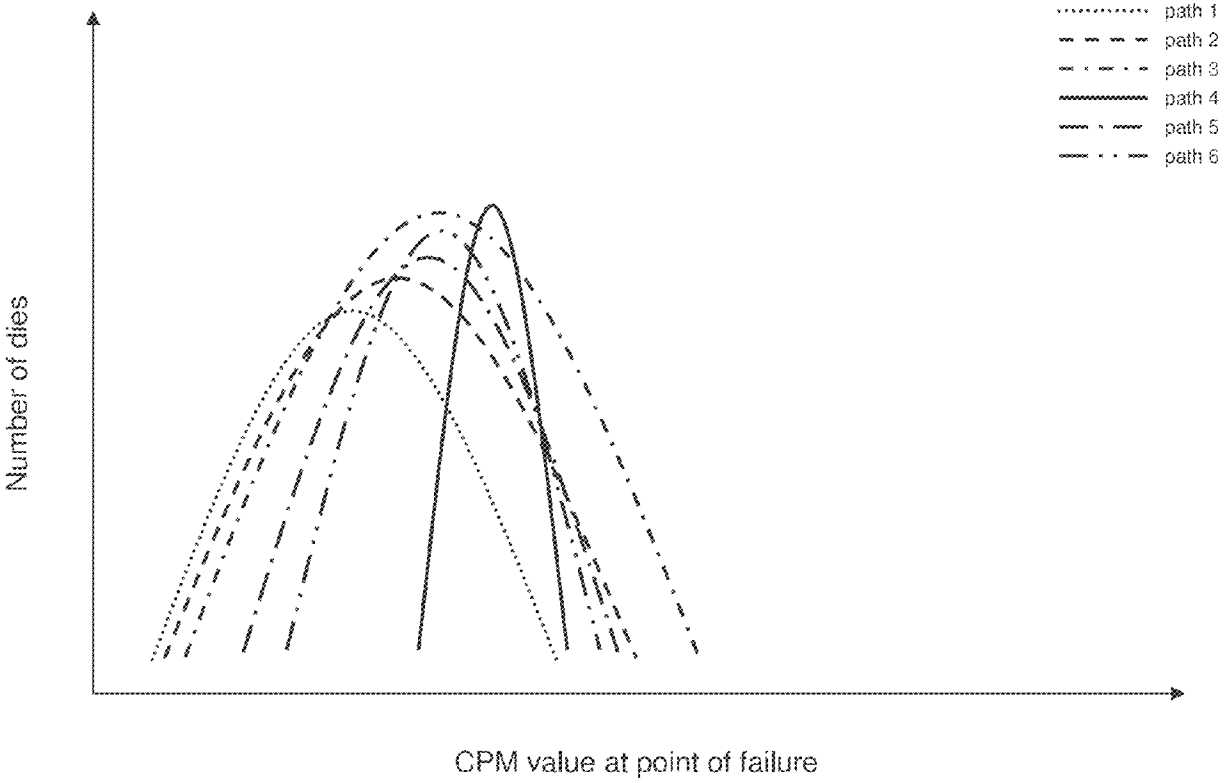
FIG. 8 shows an exemplary graph of results of performing mixed-mode testing of a step in the flow chart of FIG. 7.

FIG. 8 shows exemplary graph 800 of results of performing mixed-mode testing of step 705 of FIG. 7. Graph 800 shows distributions of CPM values at failure for six different CPM paths within a particular CPM 208 on multiple dies. Each distribution curve represents a histogram for a particular path in CPM 208 indicating the number of dies that reached failure at particular CPM values. Based on the distributions, a particular path within CPM 208 is chosen as the best representative for the corresponding logic block. The particular path chosen is the one showing the narrowest—or tightest—distribution of at-failure CPM values. In exemplary graph 800, path 4, shown with a solid line, represents the curve with the narrowest distribution.

It should be noted that CPM 208 may have a so-called sticky feature which allows the retention of a minimum, maximum, or average value during a sampling period for output at the end of the sampling period. This may provide more-useful information than simply providing the instantaneous value at the end of the sampling period. Providing, for example, the minimum CPM value presents the worst-case scenario, which is useful for conservative provision of voltage levels and operation of the IC device. Providing an average value would be useful for a less-conservative provision of voltage levels and operation of the IC device.

As would be appreciated by a person of skill in the art, various additional components may be added to the components described and shown in the simplified block diagrams. For example, signal lines from PLL module 209 and/or TAP controller 210 in FIG. 4 may include one or more buffers (not shown) for more-robust transmission of signals along relatively long lines.

An exemplary embodiment has been described where all of the CPMs 208 of IC device 201 of FIG. 2 are substantially identical. In alternative embodiments, one or more of the CPMs of IC device 201 may differ in internal structure from the other CPMs of IC device 201.

An exemplary embodiment has been described where all of the CPM envelopes 211 of IC device 201 of FIG. 2 are substantially identical. In alternative embodiments, one or more of the CPM envelopes of IC device 201 may differ in internal structure from the other CPM envelopes of IC device 201.

An exemplary embodiment has been described where AVSO controller 204 of FIG. 2 uses e-fuse block 207 for recording and retrieving CPM target value CPM_target. In alternative embodiments, a different type of non-volatile memory is used instead of an e-fuse block. Exemplary alternative types of non-volatile memory are provided below.

An exemplary embodiment has been described where IC device 201 of FIG. 2 comprises hard macro blocks having CPMs. In alternative embodiments, IC device 201 may comprise other types of logic blocks—such as, for example, soft macro blocks—having CPMs.

An exemplary embodiment has been described where calibration to determine CPM target value CPM_target is performed by an ATE apparatus as part of ATE testing. In some alternative embodiments, the calibration is performed apart from ATE testing. In some alternative embodiments, calibration is performed by an apparatus other than an ATE apparatus.

An exemplary embodiment of clock-gate circuit 501 has been described as part of envelope circuit 211 of FIG. 5. It should be noted that different clock-gate circuits may be used instead in alternative implementations. Alternative implementations may embody the same logic but implemented differently. Alternative implementations may also embody different clock-gating logic by, for example, adding or subtracting conditions for enabling use of signal 405*a* by CPM 208. In some alternative embodiments, clock-gating circuit 501 of FIG. 5 is controlled by only one of the external testing apparatus and TAP controller 210.

An exemplary embodiment of bypass circuit 502 of FIG. 5 has been described as part of envelope circuit 211 of FIG. 2. In alternative embodiments, bypass circuit 502 is implemented differently by, for example, adding or subtracting components and/or interconnections.

An exemplary embodiment of a testing and calibration process for IC devices has been described. Note that additional tests, not described, may also be performed as part of the testing process. In some alternative embodiments, one or more of the tests described as part of process 700 of FIG. 7 may be skipped.

An exemplary embodiment has been described where the functional and scan modes of the CPM and the corresponding logic blocks are the same. In other words, the frequency of the clock signals in the functional mode is the same for all components, and the frequency of the slow-clock signal in the scan mode is the same for all components. In alternative embodiments, the frequencies of the clock signal used by different components in the same mode might differ. For example, the frequency of the clock signal used by the CPM in functional mode may differ from the frequency of the clock signal used by the corresponding logic block in functional mode. Similarly, the frequency of the slow-clock signal used by the CPM in scan mode or mixed mode may differ from the frequency of the slow-clock signal used by the corresponding logic block in scan mode or mixed mode.

Exemplary embodiments have been described where modules operating in particular operational modes use clock signals of particular frequencies. It should be noted that particular frequencies may vary within certain ranges established by the IC manufacturer. The variations may be intentional frequency adjustments used to maintain IC performance characteristics within particular performance parameters.

An exemplary embodiment has been described where a slow-clock signal is provided to components of segment 400 of FIG. 4 by an external testing module. In an alternative embodiment, the slow-clock signal is generated by a module on IC device 201. The slow-clock signal may be generated, for example, by a clock-generating module similar to PLL module 209 of FIG. 2 or by a module that processes PLL clock signal 209*a* to output a slow-clock signal.

An exemplary embodiment has been described wherein the testing of the logic block comprises transition delay fault (TDF) testing of the logic block in mixed-mode operation. Alternative embodiments include different and/or additional tests of logic blocks in mixed-mode operation such as, for example, path delay fault (PDF) testing and memory built-in self test (MemBIST) testing.

References herein to the verb "to set" and its variations in reference to values of fields do not necessarily require an active step and may include leaving a field value unchanged if its previous value is the desired value. Setting a value may nevertheless include performing an active step even if the previous or default value is the desired value.

Unless indicated otherwise, the term "determine" and its variants as used herein refer to obtaining a value through measurement and, if necessary, transformation. For example, to determine an electrical-current value, one may measure a voltage across a current-sense resistor, and then multiply the measured voltage by an appropriate value to obtain the electrical-current value. If the voltage passes through a voltage divider or other voltage-modifying components, then appropriate transformations can be made to the measured voltage to account for the voltage modifications of such components and to obtain the corresponding electrical-current value.

As used herein in reference to data transfers between entities in the same device, and unless otherwise specified, the terms "receive" and its variants can refer to receipt of the actual data, or the receipt of one or more pointers to the actual data, wherein the receiving entity can access the actual data using the one or more pointers.

Exemplary embodiments have been described wherein particular entities (a.k.a. modules) perform particular functions. However, the particular functions may be performed by any suitable entity and are not restricted to being performed by the particular entities named in the exemplary embodiments.

Exemplary embodiments have been described with data flows between entities in particular directions. Such data flows do not preclude data flows in the reverse direction on the same path or on alternative paths that have not been shown or described. Paths that have been drawn as bidirectional do not have to be used to pass data in both directions.

References herein to the verb "to generate" and its variants in reference to information or data do not necessarily require the creation and/or storage of new instances of that information. The generation of information could be accomplished by identifying an accessible location of that information. The generation of information could also be accomplished by having an algorithm for obtaining that information from accessible other information.

The term "nonvolatile memory," as used herein, refers to any type of memory that substantially retains its stored contents after disconnection from its power supply, i.e., the stored contents can be retrieved after reconnecting the nonvolatile memory to a power supply. Examples of nonvolatile memory include, but are not necessarily limited to (i) fuse/antifuse devices such as OTP memory and PROM, (ii) charge-storing devices such as EPROM and EEPROM and flash ROM, (iii) magnetic media devices such as hard drives and tapes, and (iv) optical, opto-electrical, and opto-magnetic media such as CDs and DVDs.

The present invention may be implemented as circuit-based systems, including possible implementation as a single integrated circuit (such as an ASIC or an FPGA), a multi-chip module, a single card, or a multi-card circuit pack. As would be apparent to one skilled in the art, various functions of circuit elements may also be implemented as processing steps in a software program. Such software may be employed in, for example, a digital signal processor, micro-controller, or general-purpose computer.

The present invention can be embodied in the form of methods and apparatuses for practicing those methods. The present invention can also be embodied in the form of program code embodied in tangible media, such as magnetic recording media, optical recording media, solid state memory, floppy diskettes, CD-ROMs, hard drives, or any other non-transitory machine-readable storage medium, wherein, when the program code is loaded into and executed by a machine, such as a computer, the machine becomes an apparatus for practicing the invention. The present invention can also be embodied in the form of program code, for example, stored in a non-transitory machine-readable storage medium including being loaded into and/or executed by a machine, wherein, when the program code is loaded into and executed by a machine, such as a computer, the machine becomes an apparatus for practicing the invention. When implemented on a general-purpose processor, the program code segments combine with the processor to provide a unique device that operates analogously to specific logic circuits.

It will be further understood that various changes in the details, materials, and arrangements of the parts which have been described and illustrated in order to explain the nature of this invention may be made by those skilled in the art without departing from the scope of the invention as expressed in the following claims.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

Unless explicitly stated otherwise, each numerical value and range should be interpreted as being approximate as if the word "about" or "approximately" preceded the value of the value or range. As used in this application, unless otherwise explicitly indicated, the term "connected" is intended to cover both direct and indirect connections between elements.

For purposes of this description, the terms "couple," "coupling," "coupled," "connect," "connecting," or "connected" refer to any manner known in the art or later developed in which energy is allowed to be transferred between two or more elements, and the interposition of one or more additional elements is contemplated, although not required. The terms "directly coupled," "directly connected," etc., imply that the connected elements are either contiguous or connected via a conductor for the transferred energy.

The use of figure numbers and/or figure reference labels in the claims is intended to identify one or more possible embodiments of the claimed subject matter in order to facilitate the interpretation of the claims. Such use is not to be construed as limiting the scope of those claims to the embodiments shown in the corresponding figures.

The embodiments covered by the claims in this application are limited to embodiments that (1) are enabled by this specification and (2) correspond to statutory subject matter. Non-enabled embodiments and embodiments that correspond to non-statutory subject matter are explicitly disclaimed even if they fall within the scope of the claims.

Although the steps in the following method claims are recited in a particular sequence with corresponding labeling, unless the claim recitations otherwise imply a particular sequence for implementing some or all of those steps, those steps are not necessarily intended to be limited to being implemented in that particular sequence.

We claim:

1. An integrated circuit (IC) device comprising:

a first logic block having performance characteristics;

a first critical path monitor (CPM) configured to monitor the performance characteristics of the first logic block; and a first CPM envelope circuit enveloping the first CPM, wherein:

the first logic block is configured to selectively operate in a first functional mode and a first scan mode;

the first CPM is configured to selectively operate in a second functional mode and a second scan mode;

the first functional mode uses a higher clock frequency than the first scan mode;

the second functional mode uses a higher clock frequency than the second scan mode; and the first CPM envelope circuit comprises a clock-gate circuit configured to allow the IC device to operate in a mixed mode, wherein the first CPM operates in the second functional mode while the first logic block operates in the first scan mode.

2. The device of claim 1, further comprising an adaptive voltage scaling and optimization (AVSO) circuit connected to the first CPM and a voltage source, wherein the AVSO is configured to:

receive from the first CPM a first-CPM indication indicative of the performance characteristics of the first logic block;

determine a first voltage level based on at least the first-CPM indication; and control the voltage source to provide the first voltage level to the first logic block.

3. The device of claim 2, wherein the performance characteristics of the first logic block are dependent on at least the first voltage level.

4. The device of claim 2, wherein:

the AVSO circuit is configured to receive the first-CPM indication at the end of a sample period;

the first CPM is configured to have a sticky feature for providing as the first-CPM indication one of the minimum, maximum, and average performance characteristic over the sample period.

5. The device of claim 1, wherein:

the first functional mode is the same mode as the second functional mode; and the first scan mode is the same mode as the second scan mode.

6. The device of claim 1, wherein the first CPM envelope circuit further comprises a bypass circuit configured to allow selective bypassing of the first CPM.

7. The device of claim 6, wherein the bypass circuit comprises:

a lockup circuit configured to latch a scan input signal and output a corresponding lockup-circuit output; and a mux configured to selectively output one of the lockup-circuit output and an output of the first CPM.

8. The device of claim 7, further comprising a controller configured to control the mux to:

output the lockup-circuit output if the IC device is operating in the mixed-mode;

output the output of the first CPM if the first CPM and the first logic block are operating in the functional mode; and output the output of the first CPM if the first CPM and the first logic block are operating the scan mode.

9. The device of claim 1, further comprising:

a phase-lock-loop (PLL) module configured to provide a PLL clock for use by at least one of the first logic block in the first functional mode and the first CPM envelope circuit in the second functional mode; and a test access port (TAP) controller configured to provide one or more control signals to the first CPM envelope circuit.

10. The device of claim 1, wherein:

the first CPM is connected to receive a CPM clock signal at a CPM clock input; and the first CPM envelope circuit further comprises a clock-gate circuit configured to selectively activate the CPM clock input.

11. The device of claim 10, wherein:

the clock-gate circuit is configured to receive a phase-lock-loop (PLL) lock signal, a test access port (TAP) controller idle signal, and a controller ready signal; and the clock-gate circuit is configured to activate the CPM clock input when the PLL lock, TAP controller idle, and controller ready signals are all activated.

12. The device of claim 10, wherein:

the clock-gate circuit is configured to receive a phase-lock-loop (PLL) lock signal, a test access port (TAP) controller idle signal, a first controller ready signal, and a second controller ready signal; and the clock-gate circuit is configured to activate the CPM clock input when the PLL lock, TAP controller idle, and at least one of the first and second controller ready signals are all activated.

13. The device of claim 10, wherein the clock-gate circuit is configured to freeze operation of the first CPM when selecting to not activate the CPM clock input.

14. The device of claim 1, wherein:

the IC device is configured to perform a CPM calibration when operating in the mixed mode; and the IC device is configured to set a CPM_target value as part of the CPM calibration.

15. The device of claim 14, further comprising an adaptive voltage scaling and optimization (AVSO) circuit connected to the first CPM and a voltage source, wherein the AVSO is configured to:

receive from the first CPM a first-CPM indication indicative of the performance characteristics of the first logic block;

determine a first voltage level based on at least the first-CPM indication and the CPM_target value; and control the voltage source to provide the first voltage level to the first logic block.

16. The device of claim 14, wherein:

the IC device further comprises a non-volatile memory; and the setting of the CPM_target value comprises programming the non-volatile memory with the CPM_target value.

17. The device of claim 1, further comprising:

one or more additional logic blocks;

one or more additional CPMs corresponding to the one or more additional logic blocks, wherein each of the one or more additional CPMs is configured to monitor the performance characteristics of corresponding logic block of the one or more additional logic blocks; and one or more CPM envelope circuits corresponding to the one or more additional CPMs.

18. The device of claim 1, wherein the device is configured to receive the clock frequency used in the first scan mode from an external testing apparatus external to the IC device.

19. A method for an integrated circuit (IC) device comprising a first logic block having performance characteristics, a first critical path monitor (CPM), and a first CPM envelope circuit enveloping the first CPM, the CPM envelope circuit comprising a clock-gate circuit, the method comprising:

the first CPM monitoring the performance characteristics of the first logic block;

the first logic block selectively operating in any one of a first functional mode and a first scan mode;

the first CPM selectively operating in any one of a second functional mode and a second scan mode; and the clock-gate circuit allowing the IC device to operate in a mixed mode, wherein:

the first CPM operates in the second functional mode while the first logic block operates in the first scan mode;

the first functional mode uses a higher clock frequency than the first scan mode; and the second functional mode uses a higher clock frequency than the second scan mode.

20. A method for calibrating an integrated circuit (IC) device having critical path monitors (CPMs) and corresponding logic blocks, the method comprising:

performing connectivity, continuity, and leakage tests on the IC device;

then performing CPM self-tests to ensure the CPMs function;

then performing scan tests to detect structural defects in the IC device;

then performing mixed-mode testing to generate and collect CPM data, wherein:

the CPMs operate in a functional mode;

the corresponding logic blocks operate in a scan mode; and the functional mode uses a higher clock frequency than the scan mode; and then saving the mixed-mode testing results, including a CPM_target value for setting a voltage level for operation of the IC device.

* * * * *